US010654549B2

(12) United States Patent
Wilby et al.

(10) Patent No.: US 10,654,549 B2
(45) Date of Patent: May 19, 2020

(54) WINGED AUTONOMOUS UNDERWATER VEHICLE (AUV)

(71) Applicant: Raytheon Company, Waltham, MA (US)

(72) Inventors: Andrew D. Wilby, Warwick, RI (US); Emily J. Pikor, Portsmouth, RI (US); Joseph M. Misulia, Attleboro, MA (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 16/156,737

(22) Filed: Oct. 10, 2018

(65) Prior Publication Data

US 2020/0115016 A1 Apr. 16, 2020

(51) Int. Cl.

| | |
|---|---|
| ***B63G 8/16*** | (2006.01) |
| ***B63G 8/08*** | (2006.01) |
| ***B63G 8/18*** | (2006.01) |
| ***B63G 8/24*** | (2006.01) |
| ***B63G 8/04*** | (2006.01) |
| ***B63G 8/00*** | (2006.01) |

(52) U.S. Cl.

CPC ..... *B63G 8/16* (2013.01); *B63G 8/001* (2013.01); *B63G 8/04* (2013.01); *B63G 8/08* (2013.01); *B63G 8/18* (2013.01); *B63G 8/24* (2013.01); *B63G 2008/004* (2013.01)

(58) Field of Classification Search

CPC ... B63G 8/00; B63G 8/08; B63G 8/14; B63G 8/18; B63G 8/20; B63G 8/001; B63G 8/22; B63G 8/16; B63G 8/39; F42B 19/00; F42B 19/06

USPC ..... 114/23, 281, 330, 332, 337

See application file for complete search history.

(56) References Cited

U.S. PATENT DOCUMENTS

| | | | | |
|---|---|---|---|---|
| 3,183,871 A * | 5/1965 | Reder | B63G 8/18 | 114/332 |
| 3,728,982 A * | 4/1973 | Dunlap | F41G 7/00 | 114/23 |
| 5,549,065 A * | 8/1996 | Cipolla | B63G 8/18 | 114/330 |
| 5,551,364 A * | 9/1996 | Cipolla | B63G 8/18 | 114/330 |
| 5,551,365 A * | 9/1996 | Cipolla | B63G 8/14 | 114/330 |

(Continued)

*Primary Examiner* — Lars A Olson

(74) *Attorney, Agent, or Firm* — Renner, Otto, Boisselle & Sklar, LLP

(57) ABSTRACT

An underwater vehicle includes a longitudinal body that defines a longitudinal axis and is rotatable about the longitudinal axis between a forward orientation and a sideways orientation, a wing attached to the longitudinal body that is moveable between a vertically extending wing orientation when the longitudinal body is in the forward orientation and a horizontally extending wing orientation when the longitudinal body is in the sideways orientation, a propulsion system having a front propulsion device and a rear propulsion device that is arranged rearwardly along the longitudinal axis relative to the front propulsion device, and an after-propulsion system arranged at a rear end of the longitudinal body that provides thrust along the longitudinal axis. The secondary propulsion system provides thrust in a perpendicular direction relative to the longitudinal axis.

20 Claims, 4 Drawing Sheets

(56) References Cited

U.S. PATENT DOCUMENTS 6,807,921 B2 * 10/2004 Huntsman ..... B63G 8/08
114/312
7,822,552 B2 * 10/2010 Bittleston ..... G01V 1/3826
114/330

* cited by examiner

WINGED AUTONOMOUS UNDERWATER VEHICLE (AUV)

FIELD OF THE INVENTION

The invention relates to autonomous underwater vehicles (AUVs) and more particularly, to an AUV that is maneuverable with movement along a longitudinal axis of the AUV body and in a lateral direction.

DESCRIPTION OF THE RELATED ART

Some conventional AUVs are configured to travel solely in the form of underwater torpedoes. Other conventional AUVs may be configured to travel through water in the form of flat boards. In either configuration of the AUV, the conventional AUV moves efficiently in a single direction. For example, the torpedo-type AUV travels along the axis of the AUV such that the AUV is unable to hover in the water or maneuver laterally. Prior attempts at providing a maneuverable AUV have included using a large and flat AUV which is difficult to deploy and inefficient during ingress transit. Another prior attempt has included providing extended arms on the AUV that contain sensors or other devices for performing different functions of the AUV. Using the extended arms enables a wide lateral separation between the devices. However, using the extended arms is disadvantageous in that the shape of the arms causes the arms to be vulnerable to damage and difficulty in deployment of the AUV.

SUMMARY OF THE INVENTION

The maneuverable underwater vehicle described herein enables both travel of a longitudinal body of the underwater vehicle along the longitudinal axis of the body and lateral movement of the longitudinal body. The longitudinal body is rotatable about the longitudinal axis to move between a forward orientation which enables travel along the longitudinal axis and a sideways orientation which enables lateral movement. The longitudinal body further includes a wing that is moveable between a vertically extending wing orientation when the longitudinal body is in the forward traveling orientation and a horizontally extending wing orientation when the longitudinal body is in the sideways traveling orientation. When the wing is in the horizontally extending wing orientation, the span of the wing is used such that sensors may be arranged along the length of the wing to provide a physically wide lateral sensing range. In exemplary applications, the underwater vehicle may be an AUV.

The underwater vehicle further includes a stern body and a bow body that are connectable to the hull body. Accordingly, different combinations of stern bodies, bow bodies, and hull bodies may be used in the underwater vehicle. The modular underwater vehicle is advantageous in that different applications may require different hull bodies that contain variable components, such as different types of effectors, control systems, and sensors.

The underwater vehicle is moved using an after-propulsion device when the longitudinal body travels along the longitudinal axis and propulsion devices when the longitudinal body is rotated for lateral movement. The after-propulsion device may be a propeller that is arranged in the stern body and the propulsion devices may be thrusters that are arranged in the stern body and the bow body.

The underwater vehicle also includes a moveable mass assembly that alters the center of gravity of the underwater vehicle to rotate the underwater vehicle between the different orientations. The moveable mass assembly is arranged in at least one of the stern body or the bow body and includes a heavy mass that is arranged at the perimeter of the underwater vehicle body. The heavy mass is rotated around the periphery of the body such that the mass moment is maximized without providing an additional arm or structure within the body of the underwater vehicle body. The moveable mass assembly enables rotation and stabilization of the underwater vehicle during either movement along the longitudinal axis or in lateral movement.

According to an aspect of the invention, an underwater vehicle includes a rotatable winged body that has more than one propulsion device that enables the underwater vehicle to be thrusted or propelled when in different orientations.

According to an aspect of the invention, an underwater vehicle is configured for torpedo-like movement when in a forward orientation and lateral movement when in a sideways orientation.

According to an aspect of the invention, an underwater vehicle includes a stern body, a hull body, and a bow body that are removably connectable such that the underwater vehicle is modular.

According to an aspect of the invention, an underwater vehicle includes a longitudinal body that defines a longitudinal axis and is rotatable about the longitudinal axis between a forward orientation and a sideways orientation, a wing attached to the longitudinal body wherein the wing is moveable between a vertically extending wing orientation when the longitudinal body is in the forward orientation and a horizontally extending wing orientation when the longitudinal body is in the sideways orientation, a propulsion system having a front propulsion device and a rear propulsion device that is arranged rearwardly along the longitudinal axis relative to the front propulsion device, with the propulsion system providing thrust in a perpendicular direction relative to the longitudinal axis, and an after-propulsion system arranged at a rear end of the longitudinal body that provides thrust along the longitudinal axis.

According to an embodiment of any paragraph(s) of this summary, the longitudinal body includes a stern body, a bow body, and a hull body to which the stern body and the bow body are connectable.

According to an embodiment of any paragraph(s) of this summary, the wing is arranged on the hull body.

According to an embodiment of any paragraph(s) of this summary, the wing has a span that extends along at least most of a length of the hull body.

According to an embodiment of any paragraph(s) of this summary, the hull body contains at least one munition.

According to an embodiment of any paragraph(s) of this summary, the after-propulsion system includes a propeller and a plurality of stators.

According to an embodiment of any paragraph(s) of this summary, the propulsion system includes a plurality of thrusters.

According to an embodiment of any paragraph(s) of this summary, the longitudinal body includes at least one moveable mass that moves the longitudinal body between the first orientation and the second orientation and maintains a buoyancy of the longitudinal body.

According to an embodiment of any paragraph(s) of this summary, at least one moveable mass is a driven cog wheel that is arranged along a perimeter of the longitudinal body.

According to an embodiment of any paragraph(s) of this summary, the longitudinal body includes a front moveable mass and a rear moveable mass that is arranged rearwardly relative to the front moveable mass.

According to an embodiment of any paragraph(s) of this summary, the wing includes at least one sensor.

According to an embodiment of any paragraph(s) of this summary, at least one sensor includes at least one of an acoustic sensor, optical sensor, or combination thereof.

According to an embodiment of any paragraph(s) of this summary, at least one sensor includes a first sensor arranged at an end of the wing and a second sensor arranged at an opposite end of the wing relative to the first sensor.

According to an embodiment of any paragraph(s) of this summary, the underwater vehicle is autonomous.

According to another aspect of the invention, a method of forming an underwater vehicle includes forming a hull body that defines a longitudinal axis and is rotatable about the longitudinal axis between a forward orientation and a sideways orientation, attaching a bow body and a stern body to opposite ends of the hull body, attaching a wing to the hull body, wherein the wing is moveable between a vertically extending wing orientation when the hull body is in the forward orientation and a horizontally extending wing orientation when the hull body is in the sideways orientation, arranging a front propulsion device in the bow body, arranging a rear propulsion device in the stern body, wherein the front propulsion device and the rear propulsion device provide thrust in a perpendicular direction relative to the longitudinal axis, and arranging an-after propulsion system arranged at a rear end of the longitudinal body that provides thrust along the longitudinal axis.

According to an embodiment of any paragraph(s) of this summary, forming the hull body further includes selecting the hull body from a plurality of hull bodies that each have at least one different characteristic that includes one of an effector, a sensor, a launcher, a control system, or any combination thereof.

According to an embodiment of any paragraph(s) of this summary, attaching the bow body and the stern body to opposite ends of the hull body further includes selecting the bow body and the stern body from a plurality of bow bodies and stern bodies that each have at least one different characteristic that includes one of a propeller, a thruster, a stator and any combination thereof.

According to an embodiment of any paragraph(s) of this summary, the method includes arranging a moveable mass in at least one of the bow body and the stern body that rotates the hull body and maintains a buoyancy of the underwater vehicle.

According to an embodiment of any paragraph(s) of this summary, the method includes forming the wing to have a span that extends along at least most of a length of the hull body, arranging a first sensor at an end of the wing, and arranging a second sensor at an opposite end of the wing relative to the first sensor.

According to an embodiment of any paragraph(s) of this summary, the method includes providing at least one of an acoustic sensor, an optical sensor, or a combination thereof.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

The annexed drawings, which are not necessarily to scale, show various aspects of the invention.

DETAILED DESCRIPTION

The principles described herein have particular application in underwater vehicles that are suitable for use in various applications. Exemplary applications in which an underwater vehicle may be suitable for use include munition launching systems and underwater imaging. Many other applications may use a maneuverable underwater vehicle that is operable to rotate to a different orientation for different types of movement through the water. For example, the underwater vehicle may be configured for different functions that require different types of movement and thus different orientations of the underwater vehicle.

Figure 1:
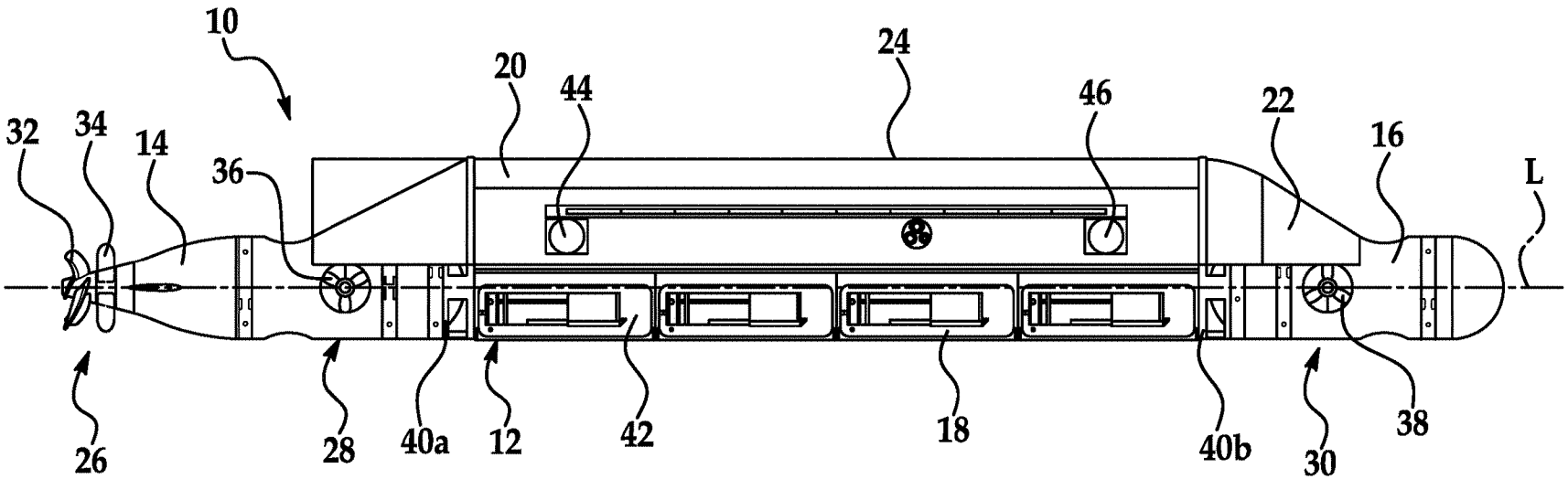
FIG. 1 is a schematic drawing showing a side sectional view of an underwater vehicle according to an embodiment of the present invention.
Figure 2:
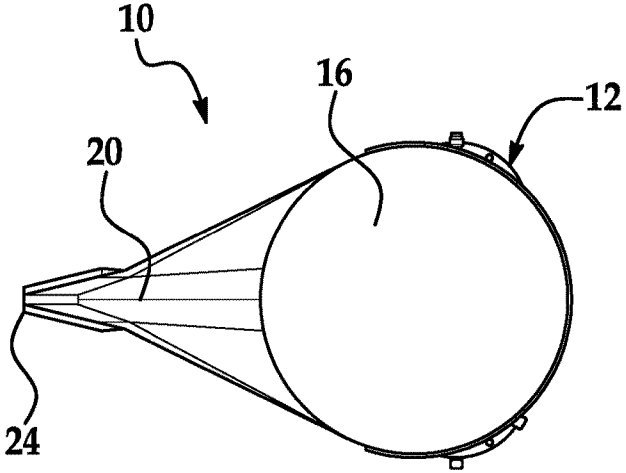
FIG. 2 is a schematic drawing showing a front sectional view of the underwater vehicle of FIG. 1 when the underwater vehicle is rotated for lateral movement.
Figure 3:
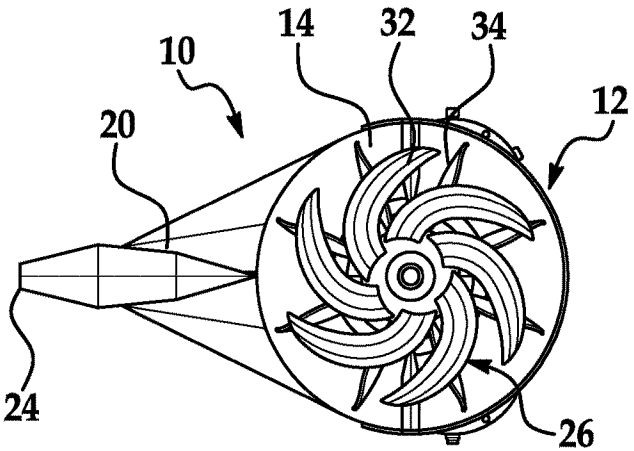
FIG. 3 is a schematic drawing showing a rear sectional view of the underwater vehicle of FIG. 2.

Referring first to FIGS. 1-3, an underwater vehicle 10 is shown. In exemplary applications, the underwater vehicle 10 may be autonomous or self-propelled. In other exemplary applications, the underwater vehicle 10 may be operated by a user and the user may be located remotely relative to the underwater vehicle 10. The underwater vehicle 10 includes a longitudinal body 12 that defines a longitudinal axis L and the longitudinal body 12 is rotatable about the longitudinal axis L. The longitudinal body 12 is generally cylindrical, elongated in shape, and formed to be neutrally buoyant. A stern body 14 is arranged at a first end of the longitudinal body 12 and a bow body 16 is arranged at a second end of the longitudinal body 12 that is opposite the first end and the stern body 14. The stern body 14 is the rear end of the underwater vehicle 10 and the bow body 16 is the front end of the underwater vehicle 10.

The longitudinal body 12 further includes a hull body 18 that is connectable between the stern body 14 and the bow body 16 such that the stern body 14 and the bow body 16 are arranged at opposite ends of the hull body 18. The hull body 18 is elongated and has a greater length as compared with the lengths of the stern body 14 and the bow body 16. The outermost diameters of the hull body 18, the stern body 14, and the bow body 16 may be similar or the same. The stern body 14 and the bow body 16 are formed as separate bodies relative to each other and the hull body 18 such that the underwater vehicle 10 may be modular. The stern body 14 and the bow body 16 may each be attachable and removable relative to the hull body 18. Thus different hull bodies may be used with different stern bodies and bow bodies depending on an application for the underwater vehicle 10. For example, one of a plurality of different hull bodies may be selected based on different characteristics of the hull body. Examples of different characteristics that the hull bodies may include at least one of an effector, a sensor, a launcher, a control system, or any combination thereof. The total length of the underwater vehicle 10 may vary depending on the lengths of the hull bodies used and the length may be variable.

A wing 20 is arranged on or attached to the longitudinal body 12 such as by being attached to the hull body 18. The wing 20 may be fixedly attached to the hull body 18. The wing 20 has a length that extends along the longitudinal body 12 of the underwater vehicle 10 and the wing 20 may have any suitable shape. The shape of the wing 20 may be dependent on the application. The width of the wing 20 may be thicker at an area along the hull body 18 to which the wing 20 is attached and the width may taper away from the hull body 18 as best shown in FIGS. 2 and 3. The thickest width of the wing 20 may be at the outer diameter of the hull body 18. The wing 20 may have a nose end 22 that tapers from a height or edge 24 of the wing 20 toward the bow body 16. The thickness of the wing 20 may taper from the hull body 18 toward the edge 24. The edge 24 of the wing 20 is aligned with the longitudinal axis L of the longitudinal body 12. The wing 20 may have a length or span that that extends along more than half of a length of the longitudinal body 12 of the underwater vehicle 10. The wing 20 is operable both in a vertically extending wing orientation, as shown in FIG. 1, and in a horizontally extending wing orientation, as shown in FIGS. 2 and 3.

As will be further described below, the wing 20 will move between the vertically extending wing orientation and the horizontally extending wing orientation based on the orientation of the rotatable longitudinal body 12. The longitudinal body 12 is rotatable about the longitudinal axis L of the longitudinal body 12 to move between a first orientation, or forward orientation, and a second orientation, or sideways orientation, such that the wing 20 fixed to the longitudinal body 12 will similarly be moved. The longitudinal body 12 further includes a vertical axis and a transverse axis and the longitudinal body 12 may be rotatable about each axis, such that the longitudinal body 12 may have a roll, pitch, and yaw movement. The roll, pitch, and yaw movements correspond to movement of the longitudinal body 12 about the longitudinal axis L, the transverse axis, and the vertical axis, respectively. Thus when the longitudinal body 12 moves from the forward orientation to the sideways orientation, the longitudinal body 12 has roll movement.

The wing 20 is in the vertically extending wing orientation when the longitudinal body 12 of the underwater vehicle 10 is in the forward orientation in which the longitudinal body 12 moves along the longitudinal axis L of the longitudinal body 12, as shown in FIG. 1, and the wing 20 is in the horizontally extending wing orientation when the longitudinal body 12 of the underwater vehicle 10 is rotated about the longitudinal axis L to the sideways orientation in which the longitudinal body 12 has lateral movement in a direction perpendicular to the longitudinal axis L of the longitudinal body 12, as shown in FIGS. 2 and 3. The longitudinal body 12 may be rotatable in an opposite rotational direction to return to the forward orientation from the sideways orientation.

Figure 4:
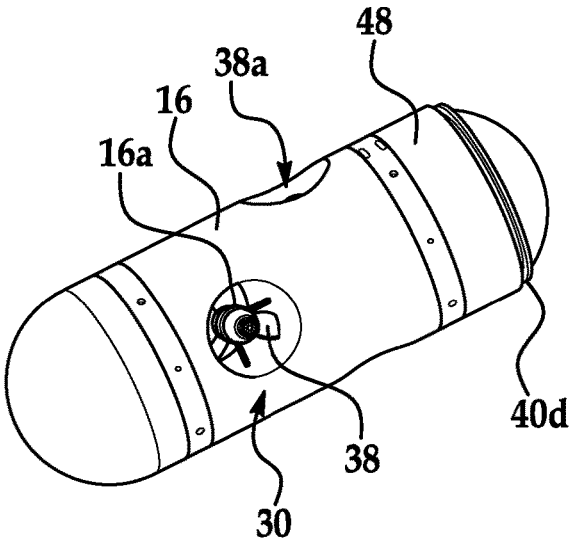
FIG. 4 is a schematic drawing showing a perspective view of a thruster section of the underwater vehicle of FIG. 1 which may be included in the bow or stern section of the vehicle.
Figure 5:
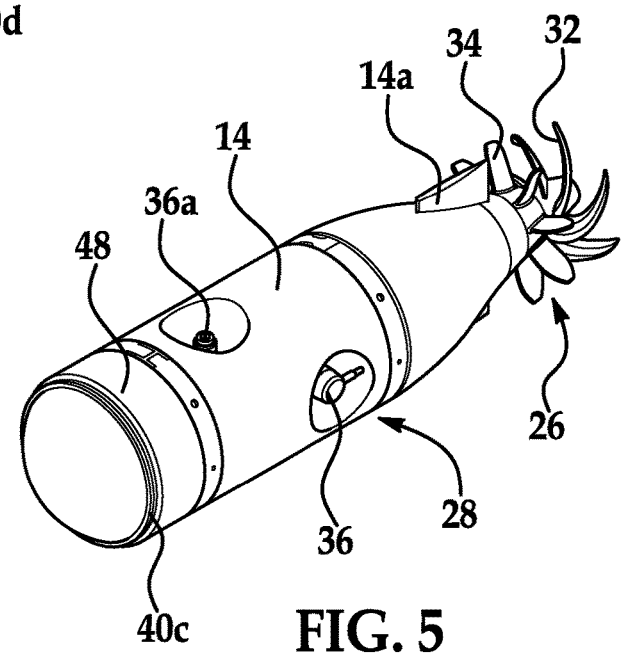
FIG. 5 is a schematic drawing showing a perspective view of a thruster section of the underwater vehicle of FIG. 1 configured with the aft propulsion propeller to be mounted at the stern of the vehicle.

Referring in addition to FIGS. 4 and 5, the underwater vehicle 10 includes a plurality of propulsion systems. Different propulsion systems may be used depending on the orientation of the longitudinal body 12 and the propulsion systems may be steerable for steering the underwater vehicle 10. For example, the underwater vehicle 10 may be propelled through the water by either an after-propulsion device 26 or propulsion devices 28, 30 depending on the orientation of the longitudinal body 12 and the wing 20. As best shown in FIGS. 1, 3, and 5, the after-propulsion device 26, or aft propulsion device, is arranged on the stern body 14. The after-propulsion device 26 may be arranged at a tail end of the stern body 14 and external to the stern body 14. The after-propulsion device 26 may include at least one propeller 32, at least one row of stators 34, or a combination thereof. In an exemplary embodiment, the after-propulsion device 26 includes a propeller 32 and the row of stators 34 as shown in FIGS. 1, 3, and 5. The propeller 32 and the stators 34 are arranged along a common axis, and the propeller 32 is arranged at a rear-most end of the stern body 14 relative to the stators 34. The after-propulsion device 26 is used to move the underwater vehicle 10 in a forward and backward direction along the longitudinal axis L of the underwater vehicle 10. The outermost diameter of the stern body 14 may gradually decrease toward the tail end of the stern body 14 at which the after-propulsion device 26 is arranged. The stern body 14 may also include additional external features that enable travel of the stern body 14 through the water, such as a fin **14*a* that protrudes from the stern body 14, as shown in FIG. 5**.

The propulsion devices 28, 30 includes a plurality of thrusters 36, 38. The thrusters 36, 38 may be rotatable about axes that are parallel with each other and the axes may be perpendicular to the common axis along which the propeller 32 and the stators 34 of the after-propulsion device 26 are arranged enabling different travel of the underwater vehicle 10. The plurality of thrusters 36, 38 includes a first thruster 36 arranged in the body of the stern body 14 and a second thruster 38 arranged in the body of the bow body 16. The thrusters 36, 38 are mounted for rotation in the corresponding body and are arranged at opposite ends of the hull body 18. The thrusters 36, 38 may be arranged in a cavity **16*a* of the bow body 16. The cavity 16*a* may be cylindrical in shape and extend through the bow body 16. The cavity 16*a* may define a longitudinal axis and the corresponding thruster 36, 38** may be arranged along the longitudinal axis for rotation.

In an exemplary embodiment, four or more thrusters may be used. Two thrusters 38, **38*a* may be arranged in the bow body 16, as shown in FIG. 4, and two thrusters 36, 36*a* may be arranged in the stern body 14. The thrusters arranged in each body may be arranged along rotational axes that are perpendicular relative to each other. During operation of the underwater vehicle 10, the after-propulsion device 26 is used when the longitudinal body 12 of the underwater vehicle 10 is in the forward orientation in which the underwater vehicle 10 moves along the longitudinal axis L of the longitudinal body 12, as shown in FIG. 1, and the propulsion devices 28, 30 are used when the longitudinal body 12 of the underwater vehicle 10 is rotated to the sideways orientation in which the underwater vehicle 10 has lateral movement in a direction perpendicular to the longitudinal axis L of the longitudinal body 12, as shown in FIGS. 2 and 3**.

As aforementioned, the stern body 14 and the bow body 16 may be formed as separate components relative to the hull body 18, such that the underwater vehicle 10 is modular and different combinations of stern bodies, bow bodies, and hull bodies may be provided. As best shown in FIGS. 4 and 5, the stern body 14 and the bow body 16 may be formed as self-contained and individual cylindrical containers that each contain or house the corresponding propulsion device. As shown in FIG. 1, the stern body 14 and the bow body 16 may be insertable into a frame or mount 40*a*, 40*b* of the hull body 18. The hull body 18 may include a mount 40*a* into which a portion 40*c* of the stern body 14 is insertable or engages, and a mount 40*b* into which a portion 40*d* of the bow body 16 is insertable or engages. Any suitable fastening mechanism may be used.

The hull body 18 may include at least one compartment 42 in an underside of the hull body 18 and the bracket 40 may be arranged adjacent the compartment 42. The hull body 18 may include a plurality of compartments that are arranged along the longitudinal axis L of the longitudinal body 12. The compartment 42 may contain any suitable electronics, sensors, payloads, munitions, other effectors, effector launchers, and any combination thereof. Examples of types of effectors that may be launched via the effector launcher include missiles, counter measure devices, flares, and non-lethal effectors. The components contained in the compartment 42 will be dependent on the application of the underwater vehicle 10 and different types of payloads and other components may be suitable for use in the compartment 42. The compartment 42 may include a control system for operating the various components of the underwater vehicle 10, which will be described further below.

Similarly to the compartment 42 of the hull body 18, the wing 20 may contain any suitable component depending on the application. For example, the wing 20 may include electronics, batteries, munitions, or other effectors such as at least one sensor, which in one embodiment may be an acoustic sensor. The control system may be in communication with the sensors to receive information from the sensors and control another function of the underwater vehicle 10 based on the information received from the sensors. The wing 20 may include separate sensors 44, 46 that are spaced and arranged at opposite ends of the span of the wing 20. The sensors 44, 46 may be arranged in any suitable arrangement and the arrangement may be dependent on the application. Spacing the sensors 44, 46 may be advantageous in an application using acoustic sensors such that a physically wide acoustic array would be provided. The spaced sensors 44, 46 would be spaced in an across-track direction when the underwater vehicle 10 is rotated to the sideways orientation shown in FIGS. 2 and 3 meaning that the span of the sensors 44, 46 would extend over the area across which the underwater vehicle 10 is traveling. Thus the span of the sensors 44, 46 would extend in a direction perpendicular to the direction of travel of the underwater vehicle 10.

Any suitable type of sensor may be used and the type of sensor used may be dependent on the application of the underwater vehicle 10. The type of sensor may be dependent on the characteristics of the underwater vehicle 10 or of an object or target that are to be detected in a specific application. More than two sensors may be provided or only one sensor may be provided. The sensors may be arranged in an array configuration. More than one type of sensor may be used.

Examples of suitable types of sensors include acoustic or sound sensors, environmental sensors, flow or fluid velocity sensors, and navigation sensors for detecting the depth, the inertia, the turning coordination, or other detectable features of the underwater vehicle. In an exemplary application, an acoustic sensor may be used to detect the location of a desirable object or target on the seabed. Navigation sensors may be used to detect the travel trajectory of the underwater vehicle 10. Other suitable sensors include position, speed, and acceleration sensors, and optical sensors. In an exemplary application, the sensors 44, 46 may be optical sensors such as camera or video sensors used to scan and image an underwater area when the underwater vehicle 10 is rotated to the sideways orientation shown in FIGS. 2 and 3. Pressure sensors, density sensors, thermal sensors, proximity sensors, time-of-travel sensors, range sensors, and radar sensors may also be suitable. For example, a proximity or radar sensor may be used to detect the proximity of the underwater vehicle 10 relative to the seabed or a desirable object or target. The aforementioned types of sensors are merely exemplary and many other types of sensors may be suitable.

Figure 6:
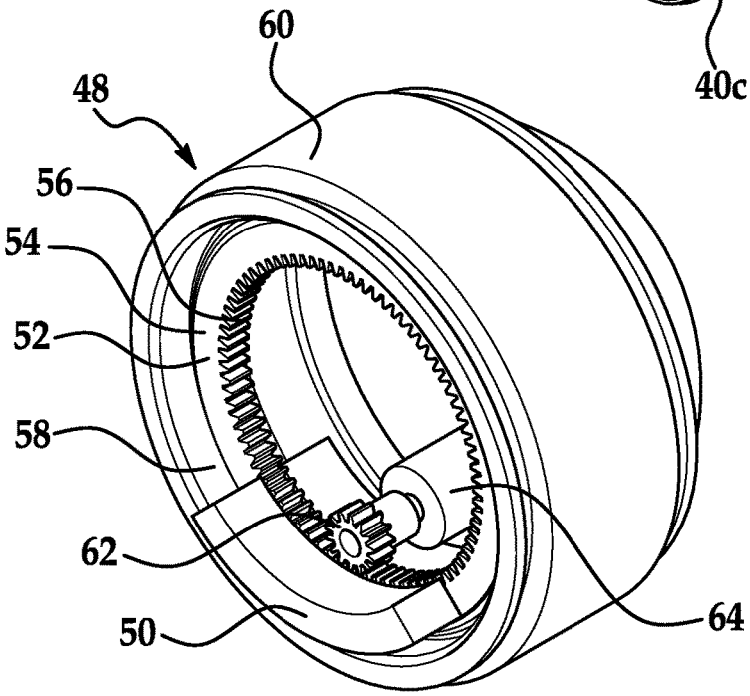
FIG. 6 is a schematic drawing showing a perspective view of a moveable mass used to rotate the underwater vehicle of FIG. 1 about the longitudinal axis of the underwater vehicle.

Referring in addition to FIG. 6, at least one of the bow body 16 and the stern body 14 includes a moveable mass assembly 48 that is used to maintain the buoyancy of the underwater vehicle 10 and to rotate the longitudinal body 12 of the underwater vehicle 10 between the forward orientation shown in FIG. 1 and the sideways orientation shown in FIGS. 2 and 3. The moveable mass assembly 48 includes a heavy mass that is rotatable along a perimeter of the underwater vehicle 10 as will be further described below. Both of the bow body 16 and the stern body 14 may have a moveable mass assembly, such as the moveable mass assembly 48. Using the moveable mass assembly 48 is advantageous in that fewer thrusters are required to move the underwater vehicle 10. Additionally, the moveable mass eliminates the use of lever arms within the body of the underwater vehicle 10, which are conventionally used to stabilize the vehicle. Thus the underwater vehicle 10 is prevented from having the shock and vibration that would result from the conventionally used lever arms within the body of the underwater vehicle 10. Additionally the volume within the underwater vehicle 10 is free for control cables and other equipment of the underwater vehicle 10 since the lever arms are not accommodating the volume. The moveable mass assembly 48 is operable to shift the center of gravity of the underwater vehicle 10 such that the longitudinal body 12 is rotatable between the forward orientation and the sideways orientation.

The moveable mass assembly 48 may be cylindrical in shape and includes a heavy mass 50 that is formed of any suitable heavy or weighted material, such as a metal. For example, the mass 50 may be formed of tungsten. The mass 50 is fixed along a cylindrical face 52 of a disk 54 or cogged wheel that has a toothed inner diameter 56. The mass 50 is formed to have a shape that is a segmented part of a hollow cylinder and a side face of the mass 50 is fixed to the cylindrical face 52 of the disk 54. The disk 54 is concentrically arranged within at least one bearing 58 arranged in a cylindrical housing 60 that is coupled to or part of the bow body 16 or the stern body 14. The outer diameter of the disk 54 is engageable against the bearing 58 of the cylindrical housing 60 such that the mass 50 is arranged at a perimeter of the underwater vehicle 10 and along the longitudinal axis L of the longitudinal body 12.

The toothed inner diameter 56 meshes with an internal drive gear 62. The internal drive gear 62 may be driven by any suitable drive mechanism. For example, the drive mechanism may be a motor 64. The motor 64 may be a conventional drive motor. The motor 64 may be a rim-driven motor. When the underwater vehicle 10 is to be rotated to another orientation, the drive mechanism is actuated by the control system of the underwater vehicle 10 and the disk 54 and the mass 50 are rotated on the bearing 58 along the periphery of the hull body 18. Accordingly, the position of the mass 50 may be rapidly and precisely controlled.

Additionally, using the mass 50 maximizes the mass moment such that the righting moment to mass ratio is also maximized. When the longitudinal body 12 of the underwater vehicle 10 is in the forward orientation, the center of gravity of the underwater vehicle 10 is in line with the center of buoyancy of the underwater vehicle 10 such that the underwater vehicle 10 does not have a righting moment. As the longitudinal body 12 of the underwater vehicle 10 is rotated toward the sideways orientation, or alternatively rotated from the sideways orientation to the forward orientation, a righting moment occurs. The moment arm is the horizontal distance between the center of gravity or the center of buoyancy and the axis of rotation. Thus the mass 50 is effectively used as a roll compensator for the underwater vehicle 10.

Figure 7:
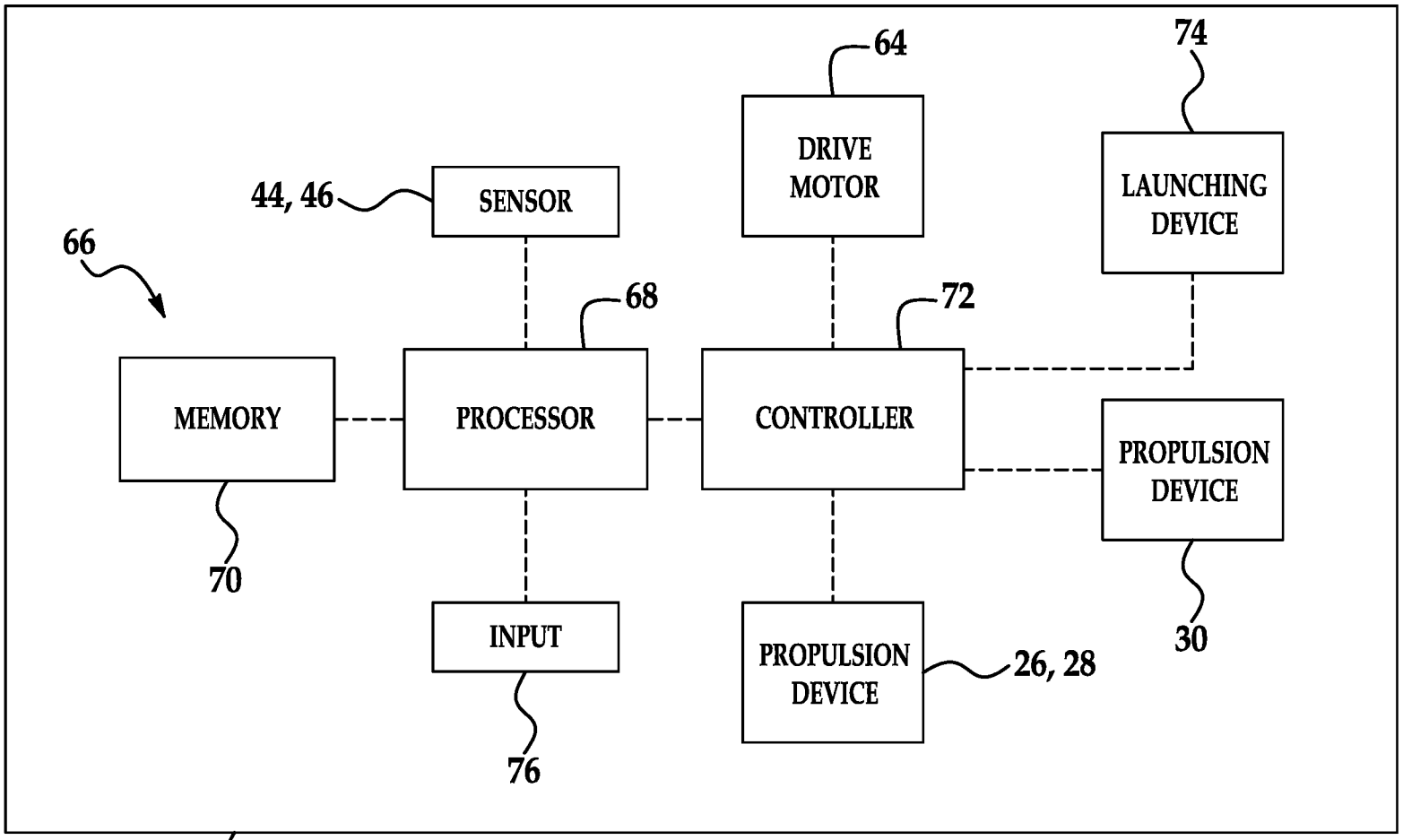
FIG. 7 is a schematic drawing showing a control system for the underwater vehicle of FIG. 1.

Referring now to FIG. 7, a schematic drawing of an exemplary control system 66 of the underwater vehicle 10 is shown. The control system 66 may include any suitable electronic components and may be stored in one of the compartments of the hull body 18. The control system 66 includes a processor 68 which may include a memory 70. In a particular application in which the underwater vehicle 10 is autonomous, the memory 70 may include stored data pertaining to a particular mission and different functions to be performed by the underwater vehicle 10. The control system 66 further includes a controller 72 that may be in communication with different components of the underwater vehicle 10 for operation of the components. For example, the controller 72 may be in communication with the propulsion devices 26, 28, 30 and the drive motor 64 for the moveable mass assembly 48. The controller 72 may be in communication with a launching device 74 for launching one of the munitions from the compartment 42 of the hull body 18.

The processor 68 may also be in communication with the sensors 44, 46 for receiving data from the sensors 44, 46 and operating the controller 72 based on the sensed data from the sensors 44, 46. In an exemplary embodiment, the processor 68 may further be configured to receive a user input or signal 76. The user input 76 may be received from a remote location relative to the underwater vehicle 10. The processor 68 may be any suitable central processing unit.

Referring now to all of FIGS. 1-7, in an exemplary operation, the longitudinal body 12 of the underwater vehicle 10 is in the forward orientation, as shown in FIG. 1, in which the longitudinal body 12 moves along the longitudinal axis L of the longitudinal body 12 via the after-propulsion device 26. The control system 66 is used to actuate the after-propulsion device 26. The longitudinal body 12 is formed to be neutrally buoyant. The underwater vehicle 10 may be autonomous or user-operated. When the longitudinal body 12 is in the forward orientation, the underwater vehicle 10 may travel and act similarly to a conventional torpedo. The wing 20 is in the vertically extending wing orientation. In an exemplary application, the underwater vehicle 10 may travel in this orientation until the underwater vehicle 10 reaches a theater of operation. Using the thruster enables the underwater vehicle 10 to efficiently ingress into theater.

When it is desirable to move the longitudinal body 12 to the sideways orientation, as shown in FIGS. 2 and 3, the moveable mass assembly 48 is actuated by the control system 66 to alter the center of gravity of the underwater vehicle 10 and rotate the longitudinal body 12 to the sideways orientation. The moveable mass assembly 48 is rotated by the drive motor 64. The controller 72 of the control system 66 may act automatically or the control system 66 may receive an appropriate user input 76 when the underwater vehicle 10 is to be operated in a different mode and orientation.

When the longitudinal body 12 is in the sideways orientation, the underwater vehicle 10 is propelled via the propulsion devices 28, 30 and the wing 20 is in the horizontally extending wing orientation such that the underwater vehicle 10 may travel and act as a flat board water vehicle or a gliding water vehicle. When the longitudinal body 12 is in the sideways orientation, the span of the wing 20 is perpendicular to the direction of travel of the underwater vehicle 10 and the underwater vehicle 10 is operable to travel in a direction that is perpendicular to the longitudinal axis L of the longitudinal body 12. The wing 20 enables the vehicle to have efficient lateral movement without significant drag while also providing a platform for the sensors. The underwater vehicle 10 is advantageous in that it enables the underwater vehicle 10 to have different orientations such that the underwater vehicle 10 may perform multiple functions that require different operational characteristics of the underwater vehicle 10.

Figure 8:
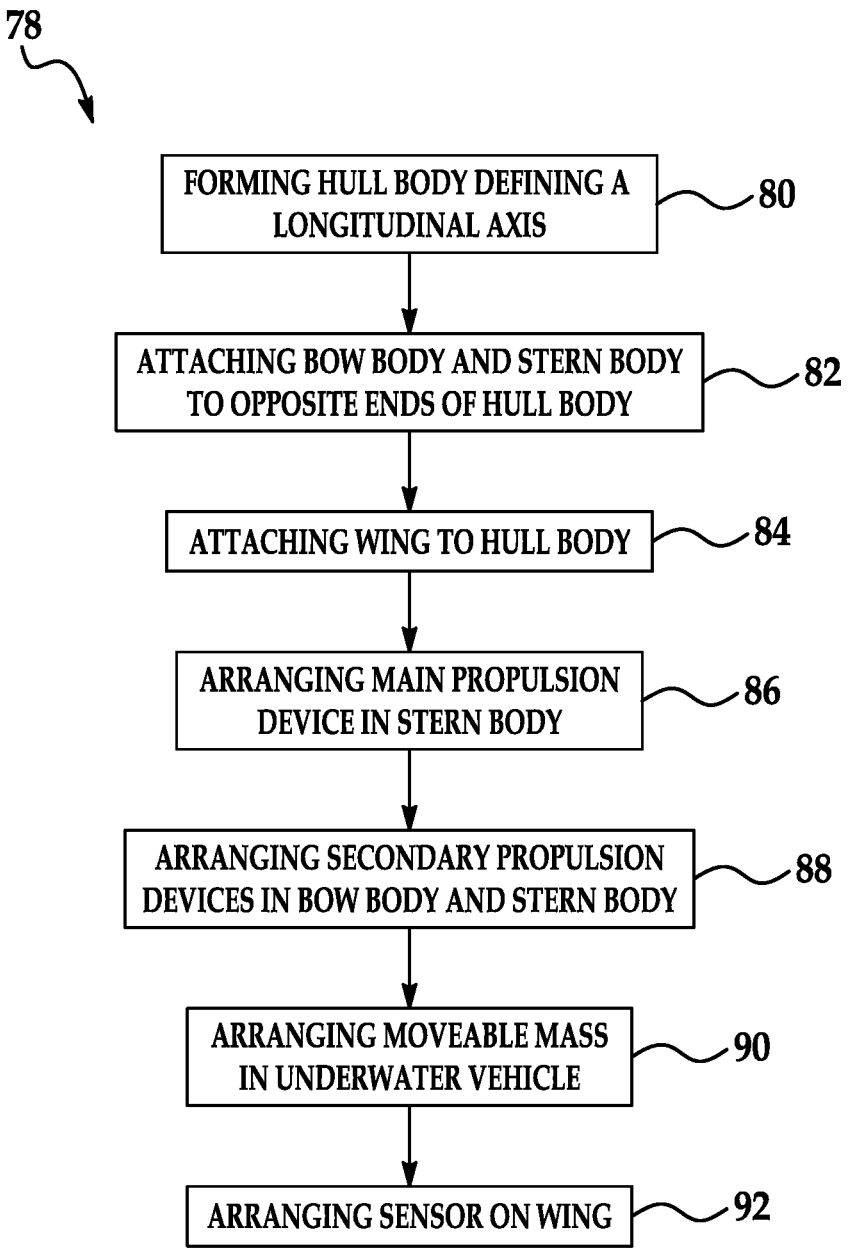
FIG. 8 is a schematic drawing showing a flowchart of a method of forming the underwater vehicle shown in FIG. 1.

Referring now to FIG. 8, a method 78 of forming an underwater vehicle 10 is schematically shown. Step 80 of the method 78 includes forming the hull body 18 (as shown in FIG. 1) having a longitudinal axis. Forming the hull body 18 may further include selecting the hull body 18 from a plurality of hull bodies that each have at least one different characteristic, such as an effector, a sensor, a launcher, a control system, or any combination thereof. Step 82 of the method 78 includes attaching the bow body 16 and the stern body 14 (as shown in FIG. 1) to opposite ends of the hull body 18. Attaching the bow body 16 and the stern body 14 to opposite ends of the hull body 18 may further include selecting the bow body 16 and the stern body 14 from a plurality of bow bodies and stern bodies that each have at least one different characteristic such as a propeller, a thruster, and any combination thereof.

Step 84 includes attaching the wing 20 (as shown in FIG. 1) to the hull body 18. Step 86 includes arranging the after-propulsion device 26 (as shown in FIGS. 1 and 5) in the stern body 14. Step 88 includes arranging propulsion devices 28, 30 in the bow body 16 and in the stern body 14. The method 78 may further include using a propeller as the after-propulsion device 26 and using a plurality of thrusters as the propulsion devices 28, 30. Step 90 may include arranging the moveable mass assembly 48 in the underwater vehicle 10. The moveable mass assembly 48 may be arranged in at least one of the stern body 14 and the bow body 16. Step 92 of the method 78 may include arranging at least one sensor 44, 46 on the wing 20. The sensors 44, 46 may be arranged at opposite ends of the wing 20. The method 78 may include arranging the at least one first sensor 44 and the at least one second sensor 46 to have a span therebetween that is perpendicular to a direction of travel of the underwater vehicle 10 when the underwater vehicle 10 has lateral movement. The method 78 may further include providing an acoustic sensor or an optical sensor.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. An underwater vehicle comprising:

a longitudinal body that defines a longitudinal axis and is rotatable about the longitudinal axis between a forward orientation and a sideways orientation;

a wing attached to the longitudinal body wherein the wing is moveable between a vertically extending wing orientation when the longitudinal body is in the forward orientation and a horizontally extending wing orientation when the longitudinal body is in the sideways orientation, wherein the wing includes a plurality of sensors arranged along an entire span of the wing;

a propulsion system having a front propulsion device and a rear propulsion device that is arranged rearwardly along the longitudinal axis relative to the front propulsion device, the propulsion system providing thrust in a perpendicular direction relative to the longitudinal axis; and an after-propulsion system arranged at a rear end of the longitudinal body that provides thrust along the longitudinal axis.

2. The underwater vehicle according to claim 1, wherein the longitudinal body includes a stern body, a bow body, and a hull body to which the stern body and the bow body are connectable.

3. The underwater vehicle according to claim 2, wherein the wing is arranged on the hull body.

4. The underwater vehicle according to claim 3, wherein the wing has a span that extends along at least most of a length of the hull body.

5. The underwater vehicle according to claim 2, wherein the hull body contains at least one munition.

6. The underwater vehicle according to claim 1, wherein the after-propulsion system includes a propeller and a plurality of stators.

7. The underwater vehicle according to claim 1, wherein the propulsion system includes a plurality of thrusters.

8. The underwater vehicle according to claim 1, wherein the longitudinal body includes at least one moveable mass that moves the longitudinal body between the first orientation and the second orientation and maintains a buoyancy of the longitudinal body.

9. The underwater vehicle according to claim 8, wherein the at least one moveable mass is a driven cog wheel that is arranged along a perimeter of the longitudinal body.

10. The underwater vehicle according to claim 8, wherein the longitudinal body includes a front moveable mass and a rear moveable mass that is arranged rearwardly relative to the front moveable mass.

11. The underwater vehicle according to claim 1, wherein the plurality of sensors includes at least one of an acoustic sensor, optical sensor, or combination thereof.

12. The underwater vehicle according to claim 1, wherein the plurality of sensors includes a first sensor arranged at an end of the wing and a second sensor arranged at an opposite end of the wing relative to the first sensor.

13. The underwater vehicle according to claim 1, wherein the underwater vehicle is autonomous.

14. A method of forming the underwater vehicle according to claim 1, the method comprising:

forming the longitudinal body to have a hull body that defines the longitudinal axis and is rotatable about the longitudinal axis between the forward orientation and the sideways orientation;

attaching a bow body and a stern body to opposite ends of the hull body;

attaching the wing to the hull body;

arranging the front propulsion device in the bow body; and arranging the rear propulsion device in the stern body, wherein the front propulsion device and the rear propulsion device provide thrust in the perpendicular direction relative to the longitudinal axis; and arranging the after propulsion system at a rear end of the longitudinal body.

15. The method of claim 14, wherein forming the hull body further includes selecting the hull body from a plurality of hull bodies that each have at least one different characteristic, the at least one different characteristic including one of:

an effector;

a sensor;

a launcher;

a control system; or any combination thereof.

16. The method according to claim 14, wherein attaching the bow body and the stern body to opposite ends of the hull body further includes selecting the bow body and the stern body from a plurality of bow bodies and stern bodies that each have at least one different characteristic, the at least one different characteristic including one of a propeller, a thruster, a stator and any combination thereof.

17. The method according to claim 14 further comprising arranging a moveable mass in at least one of the bow body and the stern body that rotates the hull body and maintains a buoyancy of the underwater vehicle.

18. The method according to claim 14 further comprising:

forming the wing to have a span that extends along at least most of a length of the hull body;

arranging a first sensor at an end of the wing; and arranging a second sensor at an opposite end of the wing relative to the first sensor.

19. An underwater vehicle comprising:

a longitudinal body that defines a longitudinal axis and is rotatable about the longitudinal axis between a forward orientation and a sideways orientation, wherein the longitudinal body includes a stern body, a bow body, and a hull body to which the stern body and the bow body are connectable;

a wing attached to the longitudinal body wherein the wing is moveable between a vertically extending wing orientation when the longitudinal body is in the forward orientation and a horizontally extending wing orientation when the longitudinal body is in the sideways orientation;

a propulsion system having a front propulsion device and a rear propulsion device that is arranged rearwardly along the longitudinal axis relative to the front propulsion device, the propulsion system providing thrust in a perpendicular direction relative to the longitudinal axis; and an after-propulsion system arranged at a rear end of the longitudinal body that provides thrust along the longitudinal axis, wherein the after-propulsion system includes a propeller and a plurality of stators.

20. An underwater vehicle comprising:

a longitudinal body that defines a longitudinal axis and is rotatable about the longitudinal axis between a forward orientation and a sideways orientation, wherein the longitudinal body includes at least one moveable mass that moves the longitudinal body between the first orientation and the second orientation and maintains a buoyancy of the longitudinal body;

a wing attached to the longitudinal body wherein the wing is moveable between a vertically extending wing orientation when the longitudinal body is in the forward orientation and a horizontally extending wing orientation when the longitudinal body is in the sideways orientation;

a propulsion system having a front propulsion device and a rear propulsion device that is arranged rearwardly along the longitudinal axis relative to the front propulsion device, the propulsion system providing thrust in a perpendicular direction relative to the longitudinal axis; and an after-propulsion system arranged at a rear end of the longitudinal body that provides thrust along the longitudinal axis.

* * * * *